United States Patent [19]

Ash

[11] Patent Number: 4,517,789

[45] Date of Patent: May 21, 1985

[54] SEPARATOR-FOLDER FOR FORM-AND-FILL PACKAGING MACHINES

[75] Inventor: Robin T. Ash, Dallas, Tex.

[73] Assignee: Frito-Lay, Inc., Dallas, Tex.

[21] Appl. No.: 519,848

[22] Filed: Aug. 3, 1983

[51] Int. Cl.[3] ..... B65B 9/10

[52] U.S. Cl. ..... 53/545; 53/551; 493/302; 493/440

[58] Field of Search ..... 53/371, 373, 545, 550, 53/551, 552; 493/248, 302, 438, 439, 440

[56] References Cited

U.S. PATENT DOCUMENTS 2,385,897 10/1945 Waters ..... 53/373

2,899,875 8/1959 Leasure ..... 493/468

4,084,999 4/1978 Rucker ..... 53/551

*Primary Examiner*—Robert L. Spruill

*Assistant Examiner*—Michael D. Folkerts

*Attorney, Agent, or Firm*—Bernard, Rothwell & Brown

[57] ABSTRACT

A form-and-fill packaging machine has a separator-folder at the cross-over for separating the web edges and folding one edge to form a fin seal in the back of the packaging tube. The separator-former is of one-piece construction generally U-shaped in section with an anti-friction surface. It reduces the effects of the friction of touching web surfaces and maintains direct control of the folding edge.

6 Claims, 7 Drawing Figures

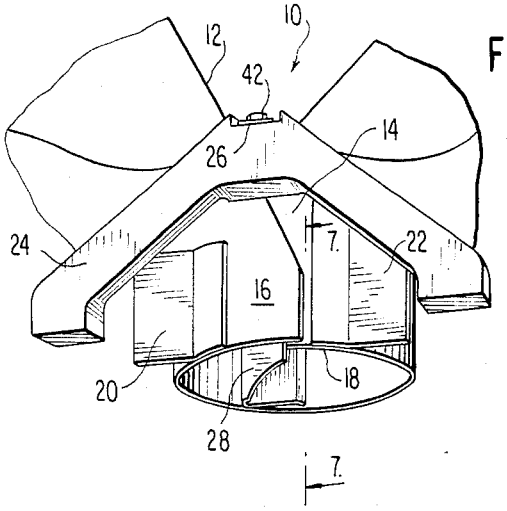
FIG. 1
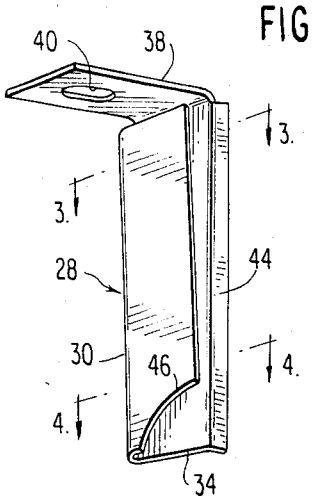
FIG. 2
FIG. 5
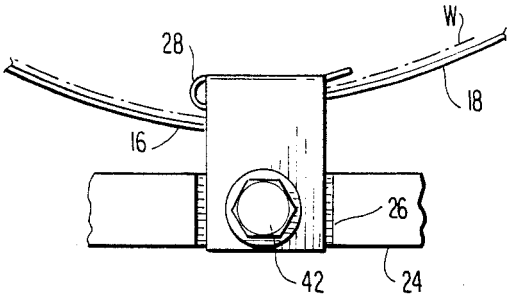
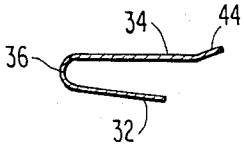
FIG. 3
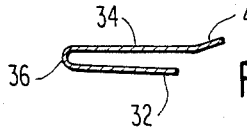
FIG. 4
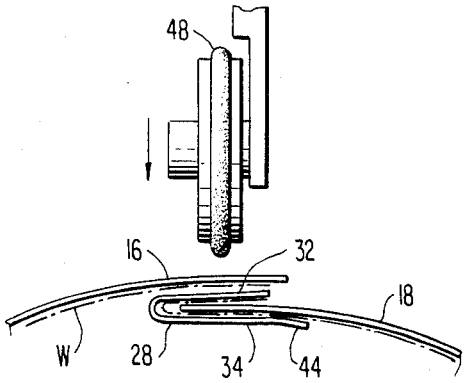
FIG. 6
FIG. 7
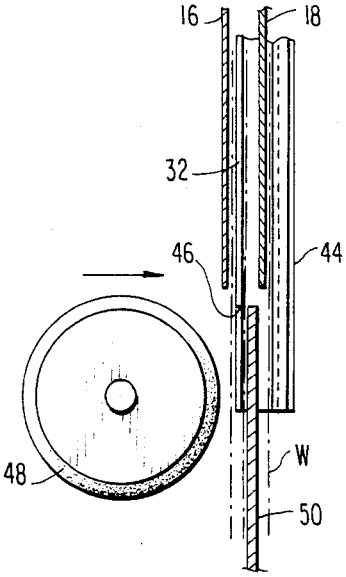

SEPARATOR-FOLDER FOR FORM-AND-FILL PACKAGING MACHINES

BACKGROUND OF THE INVENTION

1. Field of the Invention

This invention relates to improvements in form-and-fill packaging machines and particularly to a separator-folder for edges of packaging film used in such machines.

2. Background Art

Form-and-fill packaging machines are well known in the art and are commercially available. They are commonly used for simultaneously forming and filling packages with diverse material including snack foods such as potato chips and the like. In such machines a packaging film is provided in a flat web to a former which in turn guides the flat web into a tubular shape and presents the edges of the tubular web for sealing. Simultaneously, material to be packed in the packages is fed through a funnel into the formed tube. End seals seal the tube transversely at spaced points to provide the separate packages. One example of a form-and-fill machine is shown in expired U.S. Pat. No. 2,899,875, granted Aug. 18, 1959.

Form-and-fill machines include means for providing a longitudinal or back seal in the tube forming the package. This seal can either be a fin seal or an overlapping seal. In a fin seal the two edges of the tubular web have the same surface mating so that the seal extends outwardly like a fin. In an overlapping seal, the opposite surface of opposite edges of the tubular web are made so that the edges overlap. Generally, fin seals are considered advantageous.

In the handling of some packaging film in many form-and-fill machines there is no provision for adapting such machines for fin seal operation. That is, the formers of many known form-and-fill machines position the edges in overlapping fashion for an overlapping back seal.

In the handling of some packaging films with form-and-fill machines there exists a problem due to the coefficient of friction of the film operating where the edges of the film material are in contact and where they are in contact with formers, thus making control of the folding edge of the film difficult if not impossible. If the packaging film is relatively stiff the coefficient of friction usually increases and the control decreases, exascerbating the problem.

It is known in the art to use a separator between the lips of a former cross-over to separate edges of packaging material. However, such known separators do not offer folding control, and may create additional disadvantageous friction effects.

There exists a need in the art to adapt conventional equipment and use packaging materials which cannot function on conventional equipment and to improve the quality of back seals produced on form-and-fill machines.

SUMMARY OF THE INVENTION

This invention provides a separator folder device adapted for use with vertical form-and-fill packaging machines to improve the production of fin seals. The device separates the edges of a packaging film formed into tubular shape by a former and folds the inside edge of the packaging material at the former. The device reduces significantly the effects of the internal coefficient of friction of the packaging material and provides direct control of the folding edge. The result is to increase control of the packaging material at the former, improve seal quality and thereby reduce waste.

This is accomplished by providing an elongated member having a portion of U-shaped section with a low friction surface. The U-shaped section is mounted with one leg of the U between the lips of the cross-over and the other leg of the U below the lower lip with the open edge of the U-shaped section facing the lower lip so that the packaging film extending from the lower lip is folded accurately and separated from the packaging film extending from the upper lip.

BRIEF DESCRIPTION OF THE DRAWINGS

FIG. 1 is a perspective view of the former of a vertical form-and-fill machine with the separator-folder of this invention applied thereto.

FIG. 2 is a perspective view of the separator-former of this invention.

FIG. 3 is a sectional view taken along line 3—3 of FIG. 2.

FIG. 4 is a sectional view taken along line 4—4 of FIG. 2.

FIG. 5 is a top plan view of the separator-folder of this invention as applied to the former of the form-and-fill machine.

FIG. 6 is a bottom plan view showing the operation of the separator-folder and the forming edges of the form-and-fill machine and illustrating a guiding wheel.

FIG. 7 is a side elevation view showing the separator-former and its position relative to a guiding wheel.

DETAILED DESCRIPTION OF THE PREFERRED EMBODIMENTS

In FIG. 1 there is shown a portion of a vertical form-and-fill packaging machine 10, and particularly a portion of a former 12 thereof. As is well-known in the art, this former takes a flat running web and forms it into a running tubular shape. The type of former shown is available from Wright Machinery Corporation, but other types of formers could be used with minor variations in the mounting. In doing so, the former has what is known as a cross-over 14 with an outer former lip 16 and an inner former lip 18 for forming and guiding the web into a tube on the inside of the cross-over lip. There are also provided lip supports 20 and 22 and a structural cross-beam 24. The cross-beam (which is also used for mounting other items not shown) has a mounting seat 26 which accommodates mounting a separator-folder 28 of this invention.

The separator-folder 28 is formed as a single piece with an elongated section 30 formed of an outer leg 32 and an inner leg 34 with a U-shaped connector 36 thus providing an element which is generally U-shaped in section and of decreasing sectional area as can be seen by comparing FIG. 3 and FIG. 4. The separator-folder has a mounting foot 38 with a mounting slot 40 for adjustably accommodating a mounting bolt 42 and securing the separator-folder on the mounting seat 26 of the cross-beam 24. The separator-folder also has a flared edge 44 on one edge of the inner leg 34 and a cut-out portion 46 to accommodate a tracking wheel 48 which operates against a backing plate 50.

The mounting of the separator-former is such that the outer leg 32 is between the outer and inner lips 16 and 18 as shown in FIG. 6, while the inner leg 34 is inside the inner former lip 18. The U-shaped connector 36 is positioned at a space inwardly from the edge of the inner lip 18 as shown.

The separator-former has a suitable non-stick surface such as Teflon or can be completely formed of an anti-friction material. Preferably it is formed of suitable stock of thickness and gauge as comparable with formers and packaging material, but with adequate strength to maintain its position in the cross-over.

In operation, a web W of packaging material is formed into tubular shape by the former. The inner edge, however, goes into the separator-folder and is folded as shown in FIG. 6 so as to improve the fin seal after leaving the separator-folder, e.g., downstream at tracking wheel 48. The outer leg 32 of the separator-folder 28 also separates the two mating edges of what will become the fin seal while they are in the cross-over. The U-shaped connector portion 36 of the separator-folder controls the folding edge and maintains a consistent and uniform fold for the fin seal.

With conventional formers the inside edges of the web packaging material are in contact at the cross-over. If the internal coefficient friction is high, control of the folding edge is difficult, if not impossible. If the stiffness of the packaging material is high, the coefficient of friction increases and the control decreases. The separator-folder of this invention, positioned as shown, eliminates the effects of the coefficient of friction between the inside edges of the packaging web at the cross-over by separating and provides an anti-friction surface between them. This improves control of the present packaging materials and enables the use of materials that cannot be used on conventional equipment. The device also provides a very important folding feature to maintain direct control of the folding edge. This will improve the quality of the seal and reduce waste. The flared edge 44 reduces the possibility that the packaging will catch or hang up and the suitable non-stick or anti-friction surface further prevents the commonly experienced problems due to the coefficient of friction of various packaging materials. The size of the flared edge 44 will depend upon the former that is used.

As can be seen, the invention provides a unique device for separating the edges and folding the inside edge of packaging material at the former of vertical form-and-fill machines. The device performs two key functions, first reducing or eliminating the effects of the internal coefficient of friction from the inside to the inside of the web material, and secondly providing direct control of the folding edge to improve seal quality and reduce waste.

What is claimed is:

1. A separator-folder device for use in forming a web to produce a fin seal on a form-and-fill machine, the form-and-fill machine having a former for forming a flat web of packaging film into tubular shape with overlapping edges, the former including a cross-over head with separated and overlapping inner and outer lips, the separator-folder device comprising; an elongated member having at least a portion thereof U-shaped in section, means forming a low friction surface on at least a portion of the elongated member in contact with the packaging film, mounting means mounting the elongated member to the former with the legs of the U-shaped sectional portion extending parallel to and spaced from the former lips, and with the open end of the U-shaped section facing the inner former lip so that the edge of the packaging film extending from the inner former lip is folded and separated from the packaging film extending from the outer former lip.

2. A separator-folder device as in claim 1 wherein the means for forming a low friction surface comprises an anti-friction coating on the surface of the portion which is U-shaped in section.

3. A separator-folder as in claim 1 wherein the separator device is one piece of formed metal with an anti-friction coating thereon.

4. A separator-folder as in claim 1 wherein the mounting means is an integral extension of one side of the portion which is U-shaped in section.

5. A separator-former as in claim 4 wherein the integral extension is formed for releasable attachment to the former.

6. A form-and-fill machine having a former for forming packaging film from flat web-shape to tubular-shape, the former including spaced and overlapping inner and outer former lips to cause the edges of the packaging film formed into a tube to cross-over and overlap, the former including improvements for separating the edges of the packaging film at the former lips and for controllably folding the outer edge of the packaging film extending from the inner former lip, the improvements comprising; an elongated member having a U-shaped portion with a low friction surface, means mounting the elongated U-shaped member with one leg of the U between the former lips, one leg of the U-shaped member inside the inner former lip, and the open end of the U-shaped member facing the inner former lip so that the edge of the packaging film extending from the inner former lip is folded and is separated from the packaging film extending from the outer former lip as the film passes through the former prior to being sealed.

* * * * *